US011192175B2

(12) United States Patent
Imthurn et al.

(10) Patent No.: US 11,192,175 B2
(45) Date of Patent: Dec. 7, 2021

(54) SHORT BELT SIDE DAM FOR TWIN BELT CASTER

(71) Applicant: NOVELIS INC., Atlanta, GA (US)

(72) Inventors: James Alan Imthurn, Hauser, ID (US); Heinz Werner Becker, Kingston (CA)

(73) Assignee: NOVELIS INC., Atlanta, GA (US)

( * ) Notice: Subject to any disclaimer, the term of this patent is extended or adjusted under 35 U.S.C. 154(b) by 21 days.

(21) Appl. No.: 16/774,783

(22) Filed: Jan. 28, 2020

(65) Prior Publication Data

US 2020/0238371 A1 Jul. 30, 2020

Related U.S. Application Data

(60) Provisional application No. 62/797,460, filed on Jan. 28, 2019.

(51) Int. Cl.
*B22D 11/06* (2006.01)
*B22D 11/124* (2006.01)

(52) U.S. Cl.
CPC ..... *B22D 11/0677* (2013.01); *B22D 11/0605* (2013.01); *B22D 11/066* (2013.01); *B22D 11/1246* (2013.01)

(58) Field of Classification Search
CPC ..... B22D 11/0605; B22D 11/066; B22D 11/0677; B22D 11/0691
See application file for complete search history.

(56) References Cited

U.S. PATENT DOCUMENTS 3,933,193 A 1/1976 Baker et al.
4,869,310 A * 9/1989 Yanagi ..... B22D 11/066 164/431
5,080,163 A 1/1992 Blin
5,584,335 A 12/1996 Barbe et al.
2010/0243195 A1* 9/2010 Godin ..... B22D 11/066 164/459

FOREIGN PATENT DOCUMENTS

JP 09192787 A * 7/1997
WO 2010108278 9/2010

OTHER PUBLICATIONS

International Application No. PCT/US2020/015422, International Search Report and Written Opinion, dated Apr. 22, 2020, 14 pages.

* cited by examiner

*Primary Examiner* — Kevin E Yoon
(74) *Attorney, Agent, or Firm* — Kilpatrick Townsend & Stockton LLP

(57) ABSTRACT

A side dam for a continuous metal casting apparatus includes an insulator and a belt system having an endless belt. The endless belt includes a belt surface, and the endless belt is movable relative to the insulator such that a portion of the belt surface is configured to face a casting cavity of the continuous metal casting apparatus as the endless belt is moved. In some examples, the endless belt is movable in a plane of motion that is perpendicular to the belt surface.

17 Claims, 9 Drawing Sheets

SHORT BELT SIDE DAM FOR TWIN BELT CASTER

REFERENCE TO RELATED APPLICATION

This application claims the benefit of U.S. Provisional Application No. 62/797,460, filed on Jan. 28, 2019 and entitled SHORT BELT SIDE DAM FOR TWIN BELT CASTER, the content of which is hereby incorporated by reference in its entirety.

FIELD OF THE INVENTION

This application relates to a continuous casting apparatus for casting metal product. More particularly, this application relates to side dams that confine molten and semi-solid metal to a casting cavity formed between continuously moving casting surfaces.

BACKGROUND

Metal products (such as metal sheets, slabs, plates and other cast products), particularly those made of aluminum and aluminum alloys (such as lxxx series aluminum alloys, 2xxx series aluminum alloys, 3xxx series aluminum alloys, 4xxx series aluminum alloys, 5xxx series aluminum alloys, 6xxx series aluminum alloys, 7xxx series aluminum alloys, or 8xxx series aluminum alloys), are sometimes cast using a continuous casting system. In such systems, molten metal is introduced between two closely spaced (usually actively cooled) elongated moving casting surfaces forming a casting cavity. The molten metal is confined within the casting cavity until the metal solidifies, at least sufficiently to form an outer solid shell. The solidified metal strip, which may be produced in indefinite length, is continuously ejected from the casting cavity by the moving casting surfaces.

One form of such system is a twin-belt caster in which two confronting belts are rotated continuously and molten metal is introduced by a launder or injector into a thin casting cavity or mold formed between the confronting regions of the belts. An alternative is a chain block caster in which the casting surfaces are formed by a continuous chain of blocks that move around fixed paths and align with each other within the casting cavity. In a further examples, a twin roller system includes at least two twin rotating rolls, and the casting cavity is formed between the walls of the rolls. In all of these apparatuses, the molten metal is introduced at one end of the system, conveyed by the moving belts, rolls, or blocks for a distance effective to solidify the metal, and then the solidified strip emerges from between the belts, rolls, or blocks at the opposite end of the system.

In order to confine the molten and semi-solid metal within the casting cavity, i.e. to prevent the metal from escaping laterally from between the casting surfaces, metal dams may be positioned at each side of the casting apparatus. For twin-belt, twin roll, and chain block casters, side dams of this kind have been formed by a series of metal blocks joined together to form a continuous line or chain extending in the casting direction at each side of the casting cavity. These blocks, normally referred to as side dam blocks, are usually made of a heat conductive material such as cast iron or mild steel, and are trapped between and move along with the casting surfaces and are recirculated so that blocks emerging from the casting cavity exit move around a guided circuit and are fed back into the entrance of the casting cavity. The existing side dam block chains travel in a vertical plane that loops under the lower carriage in order to return from the exit end of the caster back to the entry end. Idler rollers, metal sliding guideways and lateral positioning devices are used to control the side dam blocks as they travel around the circuit. The blocks are pinned loosely to a carrier ribbon in such a manner that they are able to expand and contract with thermal variations and yet not allow the buildup of excessive gaps between blocks that would enable molten metal to run out.

While the casting belts or blocks extract heat from the molten metal passing through the casting cavity, side dams made of blocks of this kind undesirably extract heat at the sides of the cavity where the molten metal contacts the side dam blocks. This heat extraction at the sides of the cavity can cause changes in the microstructure and thickness of the metal product in those areas, resulting in undesirable side-to-center non-uniformity of the cast metal product such as shrinkage porosity, edge cracks, hot tears, etc. Moreover, the use of side dam blocks limits the ability to converge the belts to accommodate shrinkage of the metal during solidification while still maintaining the appropriate heat extraction rate from the metal.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to some examples, a side dam for a continuous metal casting apparatus includes an insulator and a belt system. In various examples, the belt system includes an endless belt that is movably supported such that the endless belt is movable relative to the insulator. In certain cases, the endless belt includes a belt surface, and a portion of the belt surface of the endless belt is configured to face a casting cavity of the continuous metal casting apparatus as the endless belt is moved. In various aspects, the endless belt is movable in a plane of motion that is perpendicular to the belt surface.

According to various examples, a side dam for a continuous metal casting apparatus includes an insulator and a belt system. In certain cases, the insulator includes an insulator surface, and the insulator surface includes a plurality of pockets. In some examples, the belt system includes an endless belt that is movably supported such that the endless belt is movable relative to the insulator. In various aspects, the endless belt includes a belt surface, and a portion of the belt surface is configured to face a casting cavity of the continuous metal casting apparatus as the endless belt is moved. In certain examples, the endless belt is movable such that the portion of the endless belt configured to face the casting cavity is adjacent to the insulator surface comprising the plurality of pockets.

According to certain examples, a side dam for a continuous metal casting apparatus includes a support and a belt system. In some cases, the belt system includes an endless belt and a tensioner. In various examples, the endless belt is movably supported on the support such that the endless belt is movable relative to the support. In some examples, the endless belt includes a belt surface, and a portion of the belt surface of the endless belt is configured to face a casting cavity of the continuous metal casting apparatus as the endless belt is moved. In certain cases, a tension of the endless belt is adjustable through the tensioner.

According to various aspects, a method of continuously casting a solidified metal product includes feeding a molten metal into a casting cavity of a continuous caster, where a portion of a belt face of an endless belt of a side dam faces the casting cavity. The method also includes advancing the molten metal through the casting cavity and solidifying the molten metal to form the solidified metal product. In some examples, advancing the molten metal includes moving the endless belt with the molten metal relative to an insulator of the side dam such that the endless belt moves adjacent to an insulator surface of the insulator comprising a plurality of pockets.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing.

In this description, reference is made to alloys identified by aluminum industry designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

Figure 1:
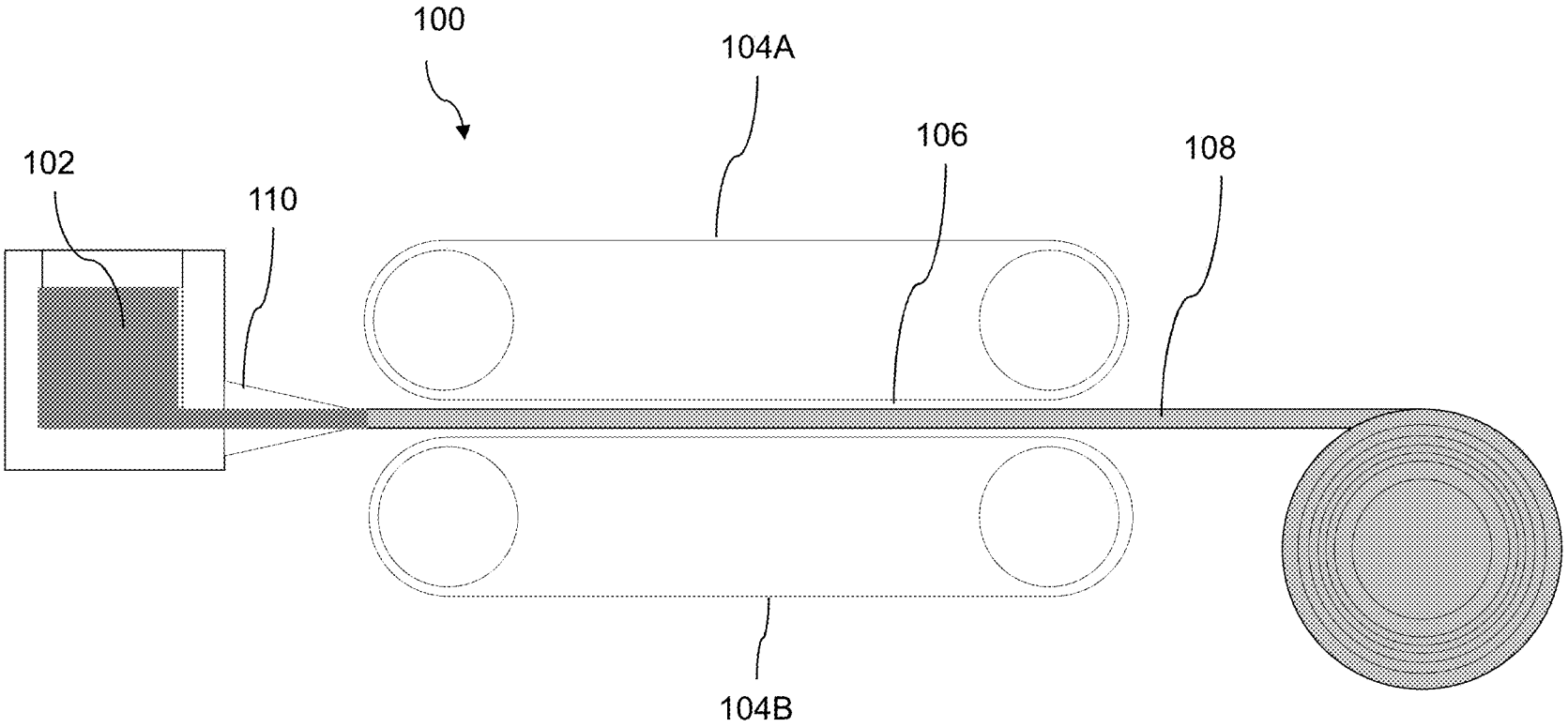
FIG. 1 is a schematic of a continuous casting system according to aspects of the present disclosure.
Figure 2:
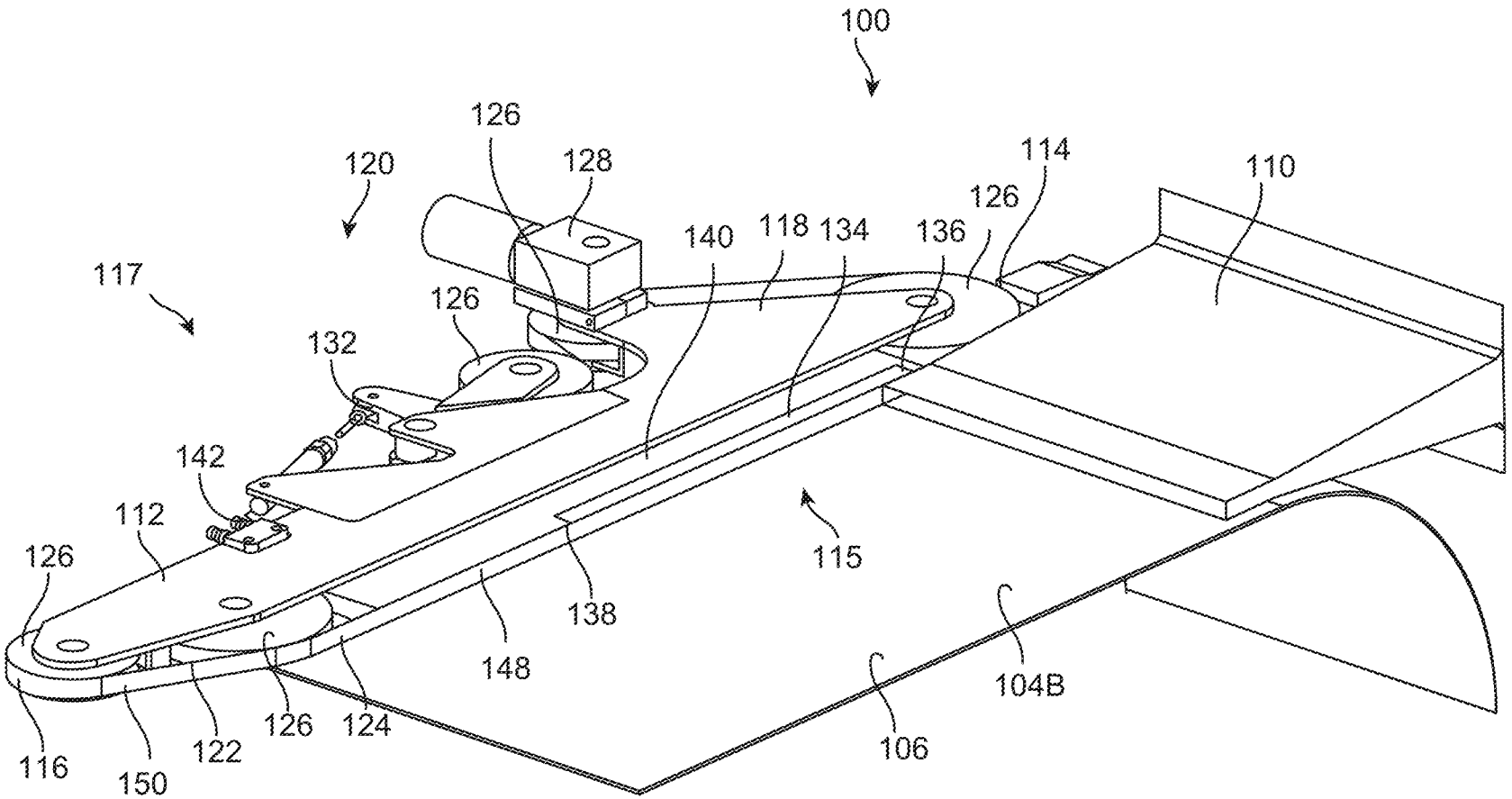
FIG. 2 is a perspective view of a portion of the continuous casting system of FIG. 1 with a side dam according to aspects of the present disclosure.

FIGS. 1 and 2 illustrate a continuous casting system 100 with at least one side dam 112. As illustrated in the example of FIG. 1, the continuous casting system 100 is a twin belt system with two confronting belts 104A and 104B having casting surfaces. Although reference will be made to the twin belt system, the continuous casting system 100 may be any type of continuous casting system, including but not limited to a twin roller system. The confronting belts 104A and 104B are rotated continuously, and molten metal 102 is introduced from an injector 20 (sometimes referred to as a nose tip or nosepiece) into a thin casting cavity or mold 106 formed between the confronting regions of the belts 104A and 104B. The solidified product 108 is continuously ejected from the casting cavity 106.

Figure 3:
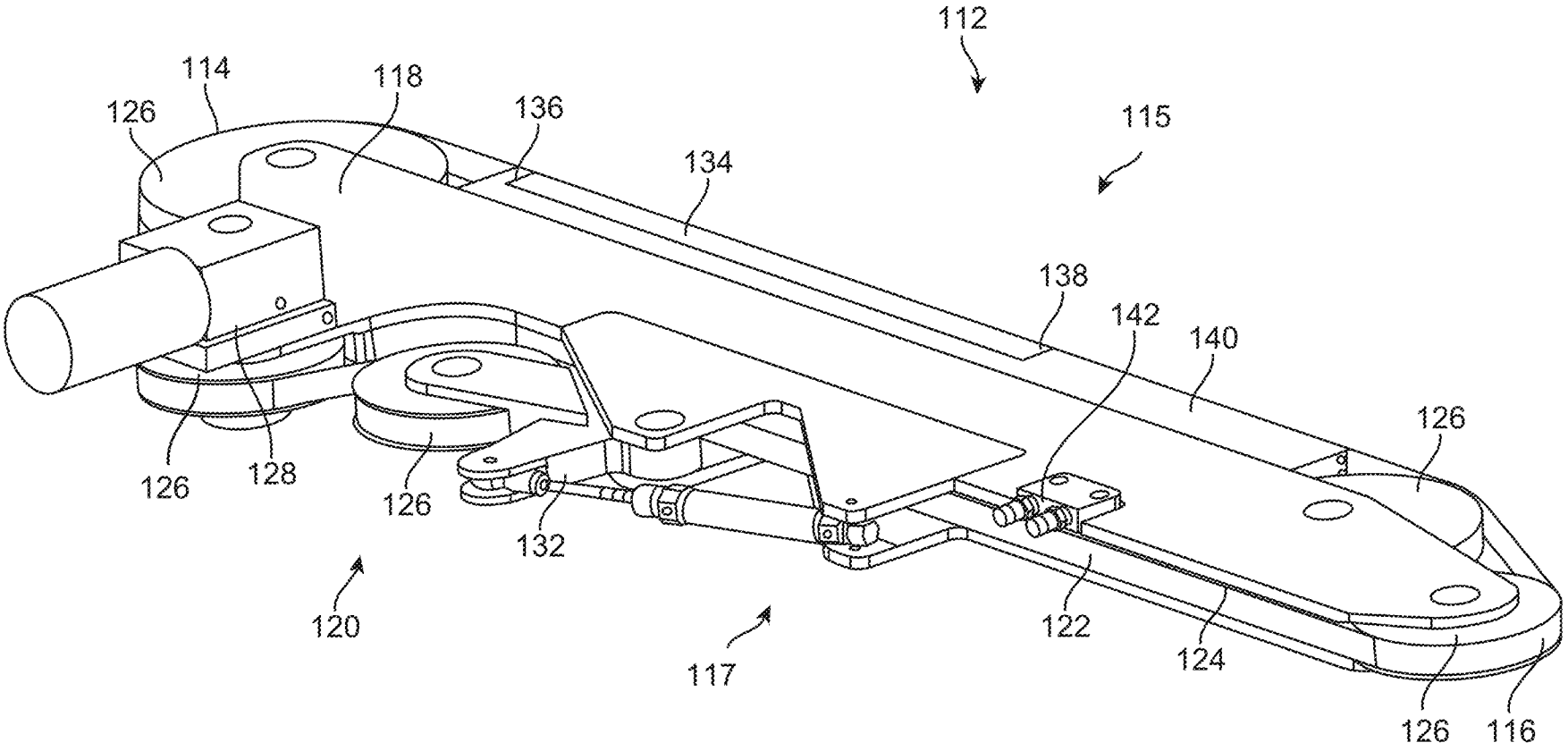
FIG. 3 is another perspective view of the side dam of FIG. 2.

As illustrated in FIGS. 2 and 3, the side dam 112 of the continuous casting system 100 includes an upstream end 114 and a downstream end 116. The side dam 112 also has a cavity-facing side 115 (i.e., the side of the side dam 112 that faces the casting cavity 106) and an outwards-facing side 117 (i.e., the side of the side dam 112 that faces away from the casting cavity 106). A distance from the upstream end 114 to the downstream end 116 defines a length of the side dam 112. The length of the side dam 112 can vary and is not limited to the arrangement shown in FIG. 2. In various examples, the length of the side dam 112 in the casting direction is less than that of the casting cavity 106 such that the side dam 112 ends before the casting cavity 106. By ending the side dam 112 before the end of the casting cavity 106, the belts 104A and 104B may optionally be configured to converge or otherwise manipulated to control the exit temperature of the metal product from the casting system 100 as desired. In some cases, a minimum length of the side dam 112 may be controlled based on a number of factors including, but not limited to, alloy, casting speed, molten metal temperature, casting gauge, cooling rate of caster, etc. In certain aspects, the side dam 112 has a minimal side dam length, which may help keep heat transfer limited to conduction through the belts 104A-B and result in more uniform plate properties across the width of the metal product. Additional benefits of the side dam 112 with the minimal length include an improved and/or smooth edge of the metal product, reduced "dog-bone" effect in the metal product where the edges of the slab tend to be thicker than the rest of the slab (e.g., middle portions of the slab), improved slab quality due to less porosity and better microstructure at the sides (which may also reduce edge trim waste), and exit slab temperature uniformity. In addition to varying the contact length in the casting direction, the side dam 112 can be relatively easily adjusted in and out of the caster to vary the degree of intimate contact with the metal product. In some aspects, varying the degree of intimate contact could influence the edge effects and be utilized to control the uniformity of the cross width exit temperature and/or the edge to center temperature difference across the width of the slab.

The side dam 112 includes a support 118, a belt system 120, and an insulator 134. Optionally, the side dam 112 also includes a cooled backing 140. In various examples, the support 118 is a mounting bar, frame, or other suitable structure on which other components of the side dam 112 may be supported. As some non-limiting examples, pulleys, the belt system 120, the insulator 134, and/or the cooled backing 140 may be directly or indirectly supported by the support 118.

The belt system 120 includes an endless belt 122 having a belt surface 124. The belt 122 may be constructed from various materials suitable for interfacing with the molten metal 102 as it solidifies including, but not limited to, copper, steel, stainless steel, or various other suitable materials. As one non-limiting example, the belt 122 may be a 120 series stainless steel, although other materials may be utilized. As described in detail below, the belt 122 and its support structure reduce the heat transfer through the edges of the cast plate or slab such that the molten metal is primarily cooled through the belts 104A-B. In various examples, the belt 122 prevents molten metal 102 from exiting the casting cavity 106 while the metal 102 solidifies.

In some optional examples, a coating may be provided on the belt 122. In such examples, the coating may further prevent adhesion of molten metal to the belt 122. In various aspects, the coating may be a permanent or temporary coating. In certain aspects, the coating may prevent wetting and may be flexible enough to remain on the belt 122 as it flexes around the pulleys (which are discussed below). In various examples, the coating may include, but is not limited to, graphite, refractory metals (molybdenum alloys, tantalum, titanium, etc.), a physical vapor deposition (e.g., with vanadium nitride, chromium nitride, combinations thereof, or various other suitable materials) or various other suitable materials for the coating.

The endless belt 122 is movably supported by a number of supports, such as pulleys 126 or other suitable supports, and is driven by a belt drive motor 128 that drives at least one pulley 126. In other examples, the belt drive motor 128 may be omitted and the belt 122 may be driven through various other suitable mechanisms. The number, location, size, or type of pulleys 126 or other supports should not be considered limiting on the current disclosure. In various examples, one or more of the pulleys 126 may be cooled through various suitable mechanisms or coolants (e.g., air cooled, water cooled, etc.) and are operable at temperatures that the side dam 112 is exposed to during casting. In certain examples, the cooled pulleys 126 may cool the belt 122 or otherwise control the temperature of the belt 122 before the belt 122 re-enters the casting cavity 106. In some cases, the cooled pulleys 126 may be from a temperature of from about 110° C. to about 400° C., although in other examples the cooled pulleys 126 may be less than about 110° C. and/or greater than about 400° C.

In various examples, the pulleys 126 may be drive pulleys, idler pulleys, and/or tensioner pulleys. In some examples, one or more of the pulleys 126 may be idler pulleys, which may reduce friction between the belt 122 and the support 118 when the belt 122 moves around certain portions of the support 118. In some non-limiting examples, the pulley 126 at the entrance of the cavity 106 (e.g., the pulley 126 at the upstream end 114) and/or the pulley 126 at the exit of the cavity 106 (e.g., the pulley 126 at the downstream end 116) may be idler pulleys, although they need not be in other examples. In various examples, one or more pulleys 126 may be coupled to a drive system of the side dam 112 (e.g., the belt drive motor 128) such that one or more of the pulleys 126 is a drive pulley that causes movement of the endless belt 122 along a path of movement. In certain examples, one or more pulleys 126 may be coupled to a tensioning system of the side dam 112 (e.g., the belt tensioner 132) such that one or more of the pulleys 126 is a tensioner pulley that controls tension in the belt 122 as it moves along its path of movement.

In certain examples, a path of movement of the endless belt 122 is in a plane that is orthogonal to the belt surface 124 (and parallel to a plane of a casting surface of the belts 104A-B). During movement of the belt 122, a portion of the belt surface 124 faces the casting cavity 106 and forms a vertical side wall of the casting cavity 106. In some examples, the belt 122 is moved (e.g., through the belt drive motor 128) at a speed that matches a speed of the belts 104A-B. In such examples, the belt 122 and belts 104A-B form a moving cavity that is static relative to the cast slab (e.g., along the top and bottom of the cast slab as well as both vertical edges). By providing a moving cavity, hot tears and/or tears associated with an edge crack are reduced or eliminated. In various aspects, the speed of the belt 122 is controlled to match a speed of belts 104A-B to achieve a relative static casting cavity 106. In various examples, a path of the endless belt 122 between the upstream end 114 and the downstream end 116 on the cavity-facing side 115 may extend in a substantially linear direction; however, in other examples, and as illustrated in FIGS. 2 and 3, the path of the endless belt 122 on the cavity-facing side 115 need not extend in a linear direction, and portions of the path of the endless belt 122 on the cavity-facing side 115 may extend at a non-zero angle relative to another portion of the path. In the example of FIGS. 2 and 3, the path of the belt 122 on the cavity-facing side 115 includes a first portion 148 and a second portion 150 between the upstream end 114 and the downstream end 116, and the second portion 150 extends at an angle relative to the first portion 148. In other examples, the path of the belt 122 on the cavity-facing side 115 may include any number of sub-portions as desired.

Although a belt drive motor 128 is illustrated, in other examples, the endless belt 122 may be driven through various other suitable mechanisms. As one non-limiting example, the endless belt 122 may be driven by the caster belt drive system (e.g., the system that drives the belts 104A-B) such that the speed of the endless belt 122 may be mechanically coupled to the belts 104A-B such that the speeds of the belt 122 and the belts 104A-B is the same and/or otherwise controlled as desired. Various other suitable mechanisms may be utilized to control the endless belt 122. In some non-limiting examples, the speed of the belt 122 may be from about 2 m/min to about 20 m/min, such as about 2 m/min, about 3 m/min, about 4 m/min, about 5 m/min, about 6 m/min, about 7 m/min, about 8 m/min, about 9 m/min, about 10 m/min, about 11 m/min, about 12 m/min, about 13 m/min, about 14 m/min, about 15 m/min, about 16 m/min, about 17 m/min, about 18 m/min, about 19 m/min, and/or about 20 m/min.

As illustrated in FIGS. 2 and 3, in some examples, the belt system 120 includes a belt tensioner 132. The belt tensioner 132 is adjustable such that a tension in the belt 122 may be controlled and adjusted as desired. In one non-limiting example, the belt tensioner 132 is a pneumatic tensioner that movably positions at least one of the pulleys 126. In other examples, other suitable types of belt tensioners 132 may be utilized. In some cases, the tension in the belt 122 is controlled to control contact between the belt 122 and the insulator 134. In various aspects, the tension in the belt is controlled to keep the belt 122 tight as the belt 122 may experience thermal growth during operation. In certain examples, the tension in the belt 122 may be controlled such that the belt 122 forms a substantially straight line in the casting cavity 106 to form a good quality edge in the metal. In certain examples, the tension in the belt 122 may be controlled to control contact between the belt 122 and the pulleys 126. In various cases, if the belt 122 is tensioned to maintain contact and/or alignment of the belt 122 on the pulleys 126.

The insulator 134 may be provided on the side dam 112 such that the belt 122 is backed by the insulator 134 while facing the casting cavity 106 along a portion of the length of the casting cavity 106. In some examples, the insulator 134 is constructed from a material that is heat resistant such that it does not break down under the continuous casting temperatures, and has low thermal conductivity to minimize or reduce heat transfer from the solidifying metal and the side dam 112. In certain examples, the insulator 134 is constructed from a material that is heat resistant, abrasion, resistant, and has a low coefficient of friction against the belt 122. In various examples, the insulator 134 may be constructed from various materials including, but not limited to, a substantially solid block of a porous graphite material, a sintered metal, or various other suitable materials. As described in detail with reference to FIGS. 4 and 5, in some examples, a surface of the insulator 134 includes a number of pockets to further reduce heat transfer. Through the insulator 134 and the belt 122, the heat transfer through the edge of the cast slab is reduced while the cast slab is cooled through the belts 104A-B.

The insulator 134 includes an upstream end 136 and a downstream end 138. Referring to FIG. 2, a distance from the upstream end 136 to the downstream end 138 is a length of the insulator 134. In various examples, the length of the insulator 134 is less than the length of the side dam 112, although it need not be. As illustrated in FIG. 2, in certain examples, the upstream end 136 of the insulator 134 is positioned upstream from the injector 20, and the downstream end 138 is a predetermined distance downstream from the injector 20. In some examples, the predetermined distance is a distance at which the metal is partially solidified. In some cases, the length of the insulator 134 may be as short as possible to yield the best edge of the material being cast and allow for maximum adjustment for convergence. In certain aspects, the length of the insulator 134 may be controlled based on alloy and cast speed. In various cases, by positioning the upstream end 136 of the insulator 134 upstream of the injector 20, the initial molten metal 102 introduced into the casting cavity 106 is less likely to freeze or stick, particularly during a start of the casting operation.

As illustrated in FIGS. 2 and 3, in some examples, the cooled backing 140 is provided with the side dam 112. The cooled backing 140 may house various suitable coolants for cooling the edge of the cast slab including, but not limited to, water, water/glycol, or various other suitable coolants. In some aspects, various nozzles or ports 142 may be provided such that the coolant can be directed into or removed from the cooled backing 140. In some examples, the insulator 134 is supported via the cooled backing 140, although it need not be. In various examples, the cooled backing 140 is provided on the side dam 112 such that the belt 122 is backed by the cooled backing 140 along a portion of the length of the casting cavity 106. In certain examples, the portion of the belt 122 cooled by the cooled backing 140 is downstream from the portion of the belt 122 backed by the insulator 134. The insulator 134 is provided on the side dam 112 such that the belt 122 is backed by the insulator 134 while facing the casting cavity 106 along a portion of the length of the casting cavity 106. In one non-limiting example, the coolant may enter the cooled backing 140 downstream from the insulator 134, travel close to the face of the cooled backing 140 to cool the belt 122, behind the insulator 134, and then exit upstream from the insulator 134. In this example, the coolant path may keep the heat isolated to the area of the insulator 134 while keeping the structure from heating up over time. In certain cases, the coolant system may be an open loop system or a closed loop system.

The orientation of the belt 122 of the side dam 112 provides a side dam 112 with much greater flexibility to be adapted to the performance needs of the casting operation compared to existing machines. For example, in some cases, the belt 122 may travel in a horizontal plane to form the edges of the casting cavity 106 (as opposed to a belt that travels in a vertical plane for the full length of the caster and loops under the lower carriage as in current machines). Movement of the belt 122 in the horizontal plane may allow for the length of the side edge of the casting cavity to be shortened or lengthened as needed depending on the operational requirements. Additionally, the side dam belt may be flared out and away from the slab if desired to reduce contact with the slab. Conversely, the side dam belt may be made to be more intimately in contact with the slab if needed. As a non-limiting examples, the side dam belts 122 on opposing side dams may converge towards each other and/or may otherwise have increased contact with the slab if desired.

Figure 4:
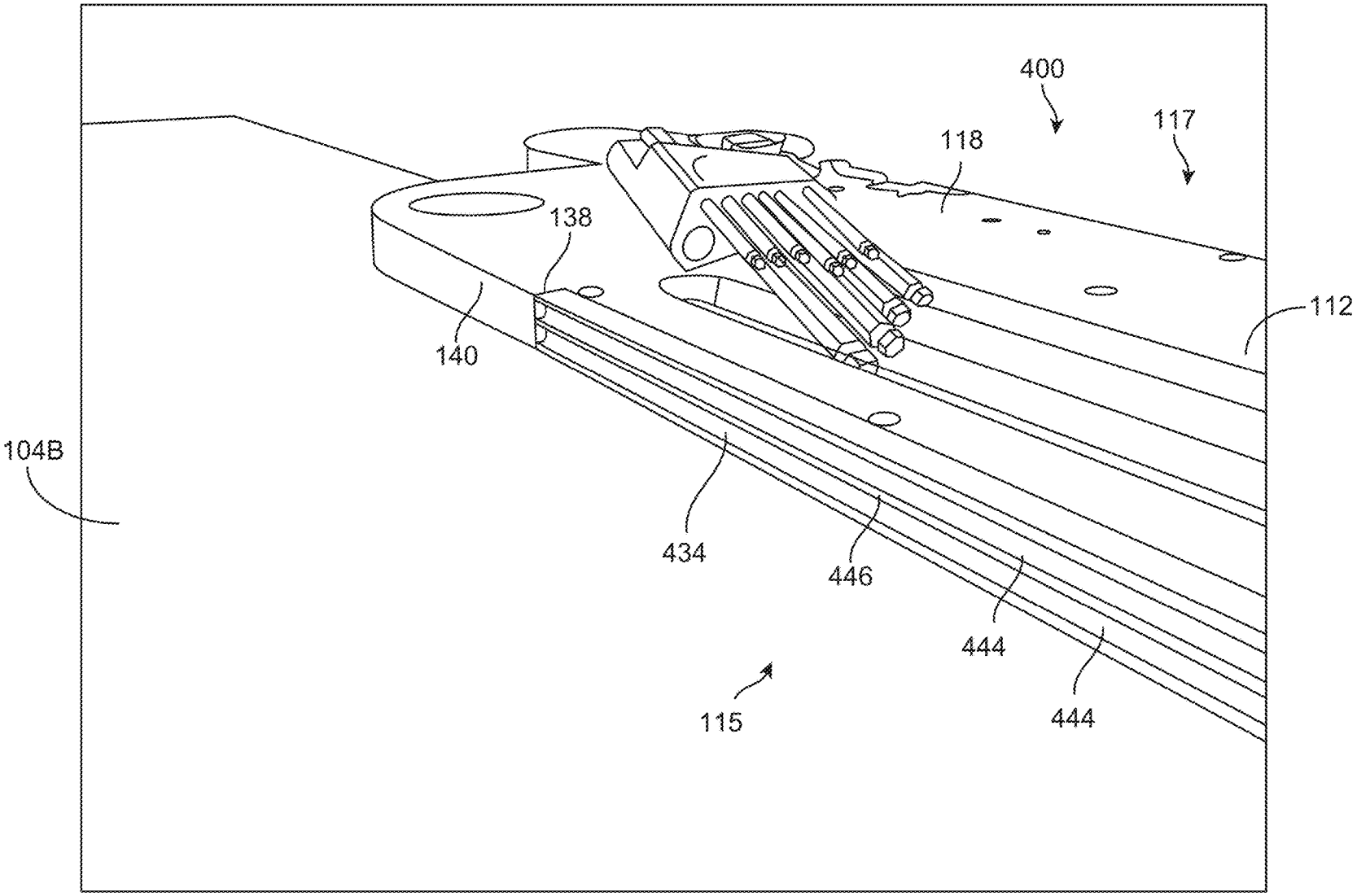
FIG. 4 illustrates a portion of a continuous casting system with a side dam according to aspects of the present disclosure.

FIG. 4 illustrates another example of a continuous casting system 400. The continuous casting system 400 is substantially similar to the continuous casting system 100 except that the insulator 434 of the side dam 112 of the continuous casting system 400 includes at least one pocket 444 in a face 446 of the insulator 434 that faces the casting cavity 106. During casting, the belt 122, which passes adjacent the insulator 434, passes adjacent the face 446 and thus adjacent the at least one pocket 444, which may further reduce heat transfer between the cast slab and the side dam 112. For example, in some cases, air within the pockets 444 may act as a further insulator and/or may further reduce or limit the heat transfer between the cast slab and the side dam 112. The number, size, shape, or pattern of the pockets 444 provided in the face 446 of the insulator 434 should not be considered limiting on the current disclosure. In some examples, a plurality of pockets 444 are provided in the face 446. In some examples, as illustrated in FIG. 4, two elongated pockets 444 are provided in the face 446. Various other patterns or combinations of patterns of pockets 444 may be utilized as desired. In some non-limiting examples, the pockets 444 are provided on up to about 60-70% of the face 446, such as from about 60-65% of the face 446. In other words, 60-65% of the insulator face is removed using pockets 444 to reduce heat transfer. In other examples, the pockets 444 may be provided on less than 60% of the face 446 or more than 70% of the face. The configurations of the pockets 444 on the face should not be considered limiting on the current disclosure.

Figure 5:
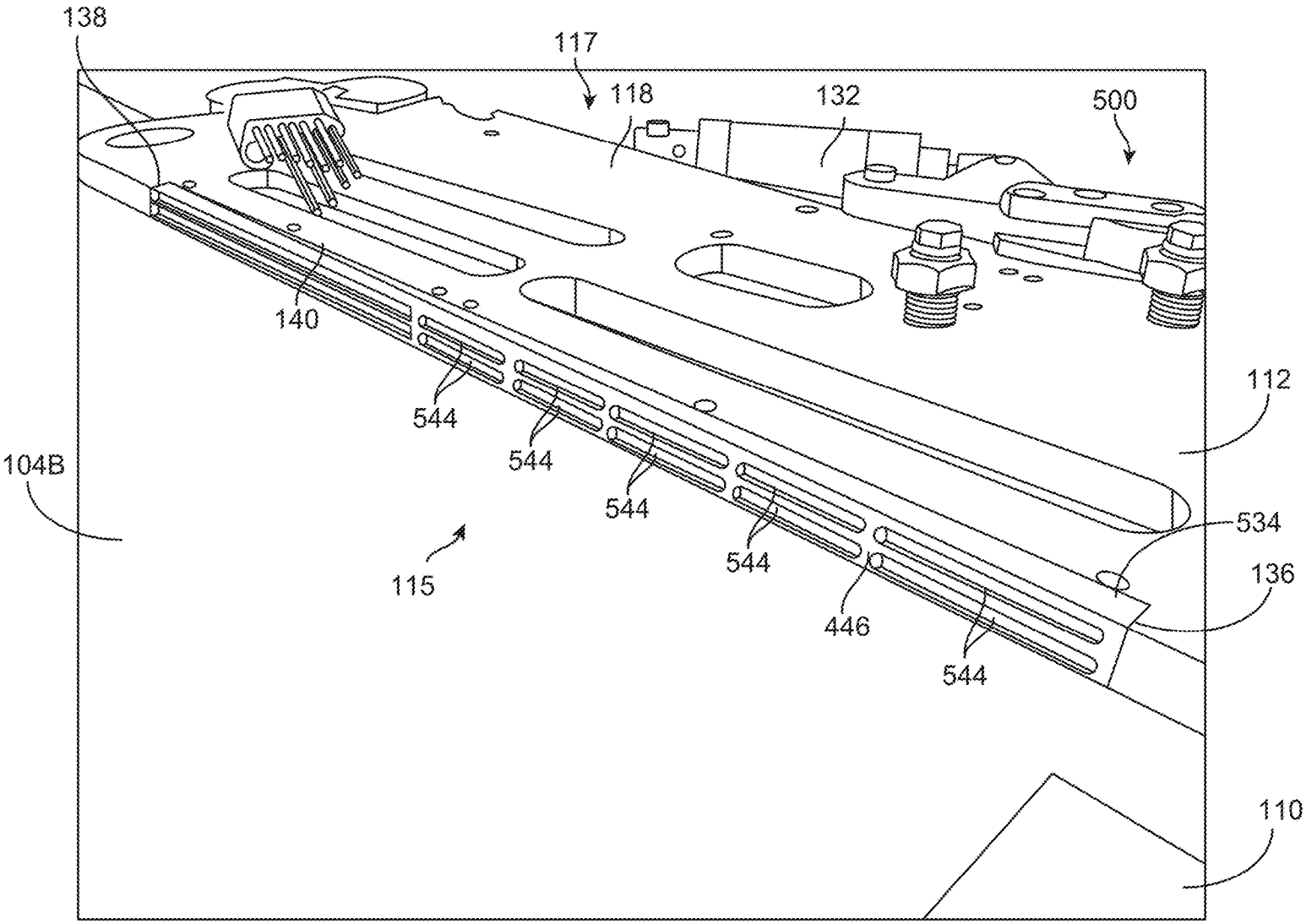
FIG. 5 illustrates a portion of a continuous casting system with a side dam according to aspects of the present disclosure.

FIG. 5 illustrates another example of a continuous casting system 500 that is substantially similar to the continuous casting system 400. Compared to the casting system 400, the insulator 534 of the side dam 112 of the casting system 500 includes pairs of pockets 544 are provided in the face 446 in intervals along the length of the insulator 534.

FIGS. 6-9 illustrate another example of a side dam 612 according to aspects of the current disclosure. The side dam 612 is similar to the side dam 112 and includes a support 618, a belt system 620, and the insulator 134. Compared to the side dam 112, the side dam 612 does not include the cooled backing 140, and the side dam 612 instead provides cooling via pulleys of the belt system 620 as discussed in detail below.

The support 618 is similar to the support 118 except that the support 618 defines one or more apertures 652 that extend through the support 118. The number, size, shape, or pattern of apertures 652 should not be considered limiting on the current disclosure. In some examples, the apertures 652 may optionally extend in a direction that is substantially perpendicular to the plane that the belt 122 is movable in. In various examples, the apertures 652 may promote air flow through the support 618 to limit heat transfer into the support 618 outside of the casting cavity 106.

The belt system 620 is similar to the belt system 120 and includes the endless belt 122, pulleys 626, the drive motor 128, and a belt tensioner 632. Compared to the path of the belt 122 in the belt system 120, the path of the belt 122 on the cavity-facing side 115 of the side dam 612 includes the first portion 148, the second portion 150, and a third portion 656 that extends at an angle relative to the first portion 148.

The pulleys 626 of the belt system 620 include at least one drive pulley 626A, at least one idler pulley 626B, and at least one tensioner pulley 626C. It will be appreciated that in other examples, other combinations or sub-combinations of pulleys may be utilized, and/or other types of pulleys may be utilized. As illustrated in FIGS. 6-10, in some examples, idler pulleys 626B are at opposing ends of the side dam 612 such that the tensioner pulleys 626C are at opposing ends of the casting cavity 106. The idler pulleys 626B at opposing ends of the side dam 612 may optionally reduce friction between the belt 122 and the support 618 when the belt 122 moves around those portions of the support 618. In some examples, one or more of the pulleys 626 are cooled using various suitable coolants or combinations of coolants such as air, water, oil, etc. The pulleys 626 may be internally cooled or externally cooled as desired. In various examples, cooled pulleys 626 may cool the belt 122 before it re-enters the casting cavity 106 and may be able to keep the belt 122 at lower temperatures compared to non-cooled pulleys. In the example of FIGS. 6-10, the drive pulley 626A and the tensioner pulley 626C are internally cooled with compressed air and the idler pulleys 626B are air cooled via apertures defined in the pulleys. In other examples, the coolant may be other suitable types of coolants as desired. In this example, the port 142 may be in fluid communication with the drive pulley 626A and the tensioner pulley 626C such that the coolant can be selectively supplied to and removed from the pulleys.

Figure 6:
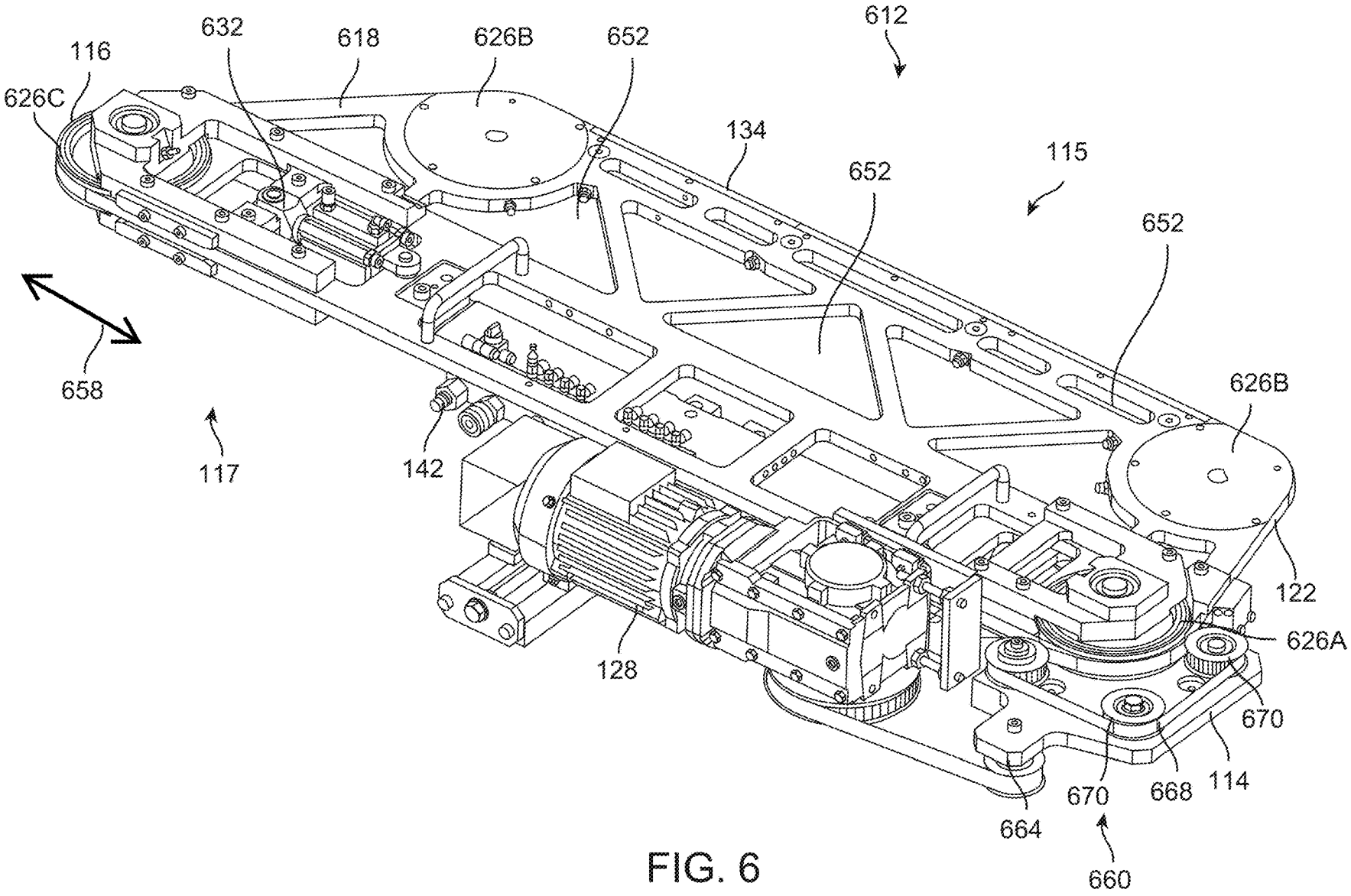
FIG. 6 is a top perspective view of a side dam according to aspects of the present disclosure in a belt pinch configuration.
Figure 7:
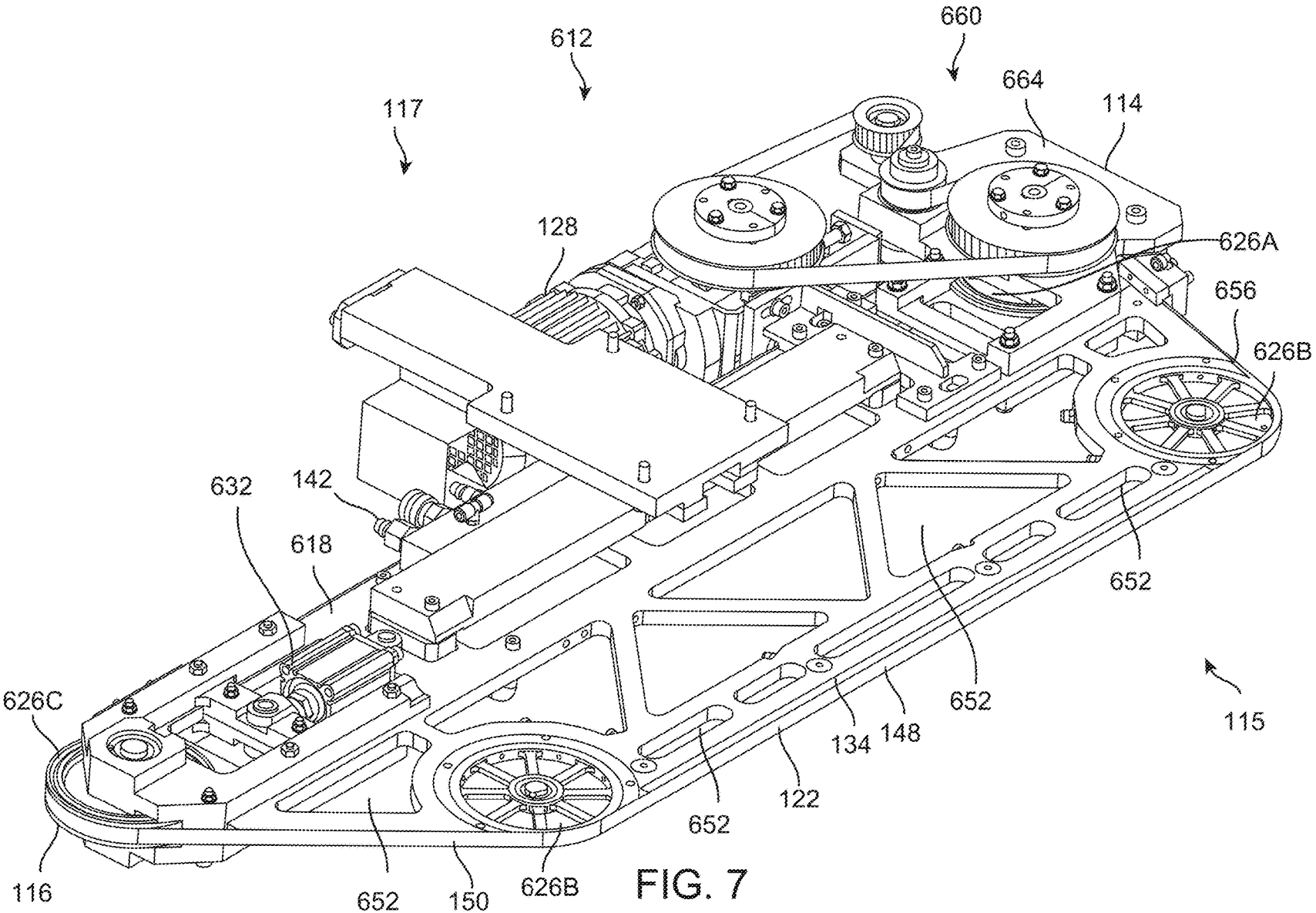
FIG. 7 is a bottom perspective view of the side dam of FIG. 6 with the first pressing system.
Figure 8:
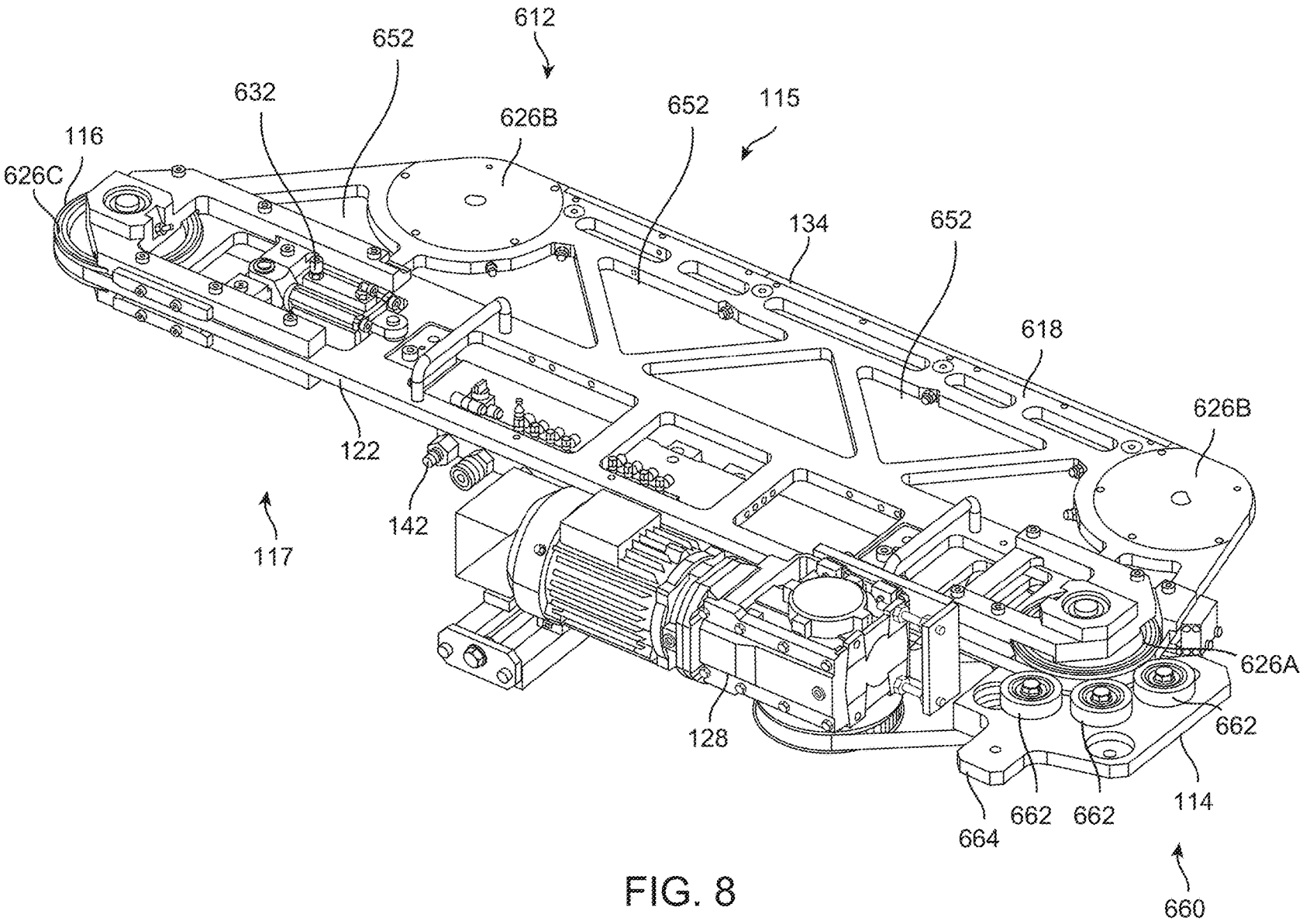
FIG. 8 is a top perspective view of the side dam of FIG. 6 with a second pressing system.
Figure 9:
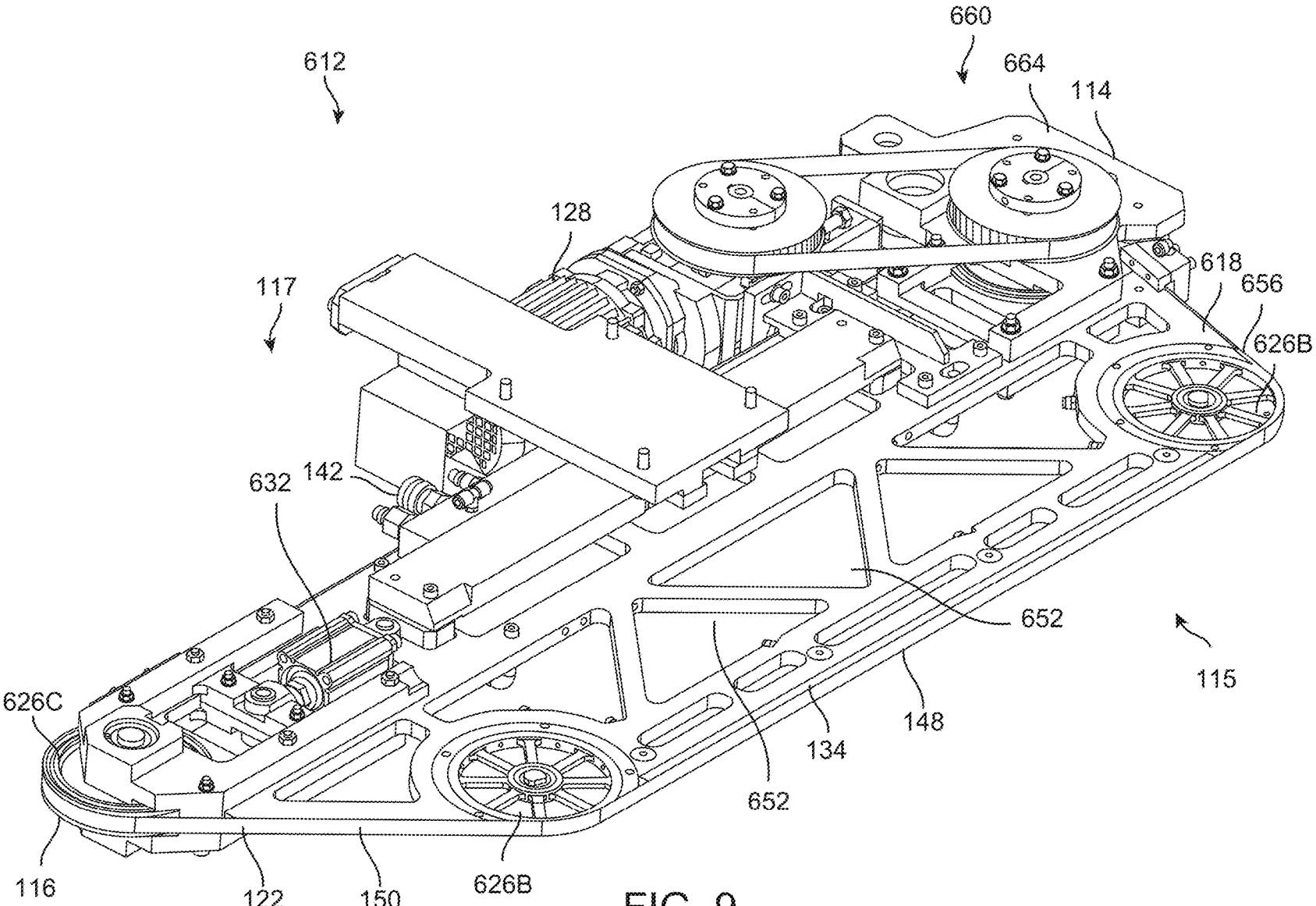
FIG. 9 is a bottom perspective view of the side dam of FIG. 6 with the second pressing system.

Compared to the belt tensioner 132 of the side dam 112, the belt tensioner 632 of the side dam 612 is a linear tensioner that selectively moves the tensioner pulley 626C along an axis (movement represented by arrow 658 in FIG. 6). In the example of FIGS. 6-9, the axis of movement of the linear tensioner is substantially parallel to an axis extending from the upstream end 116 and the downstream end 114 of the side dam 612. In other examples, the axis of movement of the linear tensioner need not be substantially parallel to the axis extending from the upstream end 116 to the downstream end 114. In some cases, the linear belt tensioner 632 may require less bending of the belt 122 during operation and may facilitate removal or installation of the belt 122 on the side dam 612.

In various examples, the belt system 620 also includes a pressing system 660 that may keep the belt 122 pressed against the surface of the drive pulley 626A. The pressing system 660 may be supported on a pressing system support 664 that may be coupled to or integrally formed with the support 618. In various examples, the pressing system support 664 is able to support more than one type of pressing system 660 such that the type of pressing system 660 can be changed as desired. In other examples, and referring to FIGS. 6 and 7, the pressing system 660 includes a pressing belt 668 supported on one or more pulleys 670, and the pressing belt 668 presses against the belt 122 and the drive pulley 626A. In other examples, and referring to FIGS. 8 and 9, the pressing system 660 includes pinch rollers 662 that press against the belt 122 and the drive pulley 626A. In various examples, one or more of the pulleys 670 may optionally be directly driven, and the remaining pulleys 670 may be idler pulleys.

In various examples, a method of continuously casting a metal product includes feeding the molten metal 102 into the casting cavity 106. In some examples, feeding the molten metal 102 into the casting cavity 106 includes feeding the molten metal 102 adjacent the movable belt 122 of the side dam 112 (or the side dam 612) such that the belt surface 124 faces the molten metal 102. In some non-limiting examples, the molten metal 102 may include aluminum, including, but not limited to, a 1xxx series aluminum alloy, a 2xxx series aluminum alloy, a 3xxx series aluminum alloy, a 4xxx series aluminum alloy, a 5xxx series aluminum alloy, a 6xxx series aluminum alloy, a 7xxx series aluminum alloy, or an 8xxx series aluminum alloy. In other examples, the molten metal 102 may be aluminum, aluminum alloys, copper, copper-based materials, steel, steel-based materials, or various other materials suitable for continuous casting.

In various examples, the method includes advancing the molten metal 102 through the casting cavity 106 and solidifying the molten material to form the solidified metal product 108. In some examples, advancing the molten metal 102 includes moving the endless belt 122 on the side dam 112 at a speed that matches a speed of the belts 104A-B such that the belts 122 and 104A-B form a moving cavity that is static relative to the molten metal 102. In various examples, moving the belt 122 includes driving the belt 122 with the belt drive motor 128. In certain cases, moving the belt 122 includes moving the belt 122 adjacent to the face 446 of the insulator 134 having at least one pocket 444. In some examples, moving the belt 122 includes moving the belt 122 along a path in a plane that is perpendicular to the belt surface 124. Optionally, the plane is a horizontal plane. In some examples, the method includes adjusting a tension of the belt 122 with the belt tensioner 132.

A collection of exemplary examples, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. A side dam for a continuous metal casting apparatus comprising: an insulator; and a belt system comprising an endless belt movably supported such that the endless belt is movable relative to the insulator, wherein the endless belt comprises a belt surface and a portion of the belt surface of the endless belt is configured to face a casting cavity of the continuous metal casting apparatus as the endless belt is moved, and wherein the endless belt is movable in a plane of motion that is perpendicular to the belt surface.

Example 2. The side dam of any preceding or subsequent examples or combination of examples, wherein the belt system further comprises: at least one pulley supporting the endless belt; a belt drive motor configured to move the endless belt relative to the insulator; and a belt tensioner configured to adjust a tension of the endless belt.

Example 2a. The side dam of any preceding or subsequent examples or combination of examples, wherein the belt system further comprises at least one pulley supporting the endless belt, and wherein the at least one pulley is a cooled pulley.

Example 2b. The side dam of any preceding or subsequent examples or combination of examples, wherein the at least one pulley is internally cooled.

Example 2c. The side dam of any preceding or subsequent examples or combination of examples, wherein the at least one pulley is air cooled or water cooled.

Example 2d. The side dam of any preceding or subsequent examples or combination of examples, wherein the belt system further comprises at least one pulley supporting the endless belt, and wherein the at least one pulley comprises at least one of an idler pulley, a drive pulley, or a tensioner pulley.

Example 2e. The side dam of any preceding or subsequent examples or combination of examples, further comprising a belt tensioner, and wherein the belt tensioner is a linear belt tensioner.

Example 2f. The side dam of any preceding or subsequent examples or combination of examples, wherein the side dam further comprises a cavity-facing side and an outwards facing side, and wherein a path of the endless belt along the cavity-facing side comprises a first portion and a second portion, and wherein the portion of the endless belt in the first portion of the path is non-coplanar in a direction along a length of the side dam with a portion of the endless belt in the second portion of the path.

Example 3. The side dam of any preceding or subsequent examples or combination of examples, further comprising: a support; and a water cooled backing connected to the support, wherein the insulator is supported on the water cooled backing, wherein the endless belt is movably supported on the support and the endless belt is movable between the insulator and the casting cavity and between the water cooled backing and the casting cavity.

Example 4. The side dam of any preceding or subsequent examples or combination of examples, wherein the side dam comprises a side dam length, wherein the insulator comprises an insulator length, and wherein the insulator length is less than the side dam length.

Example 5. The side dam of any preceding or subsequent examples or combination of examples, wherein the side dam length is less than a length of the casting cavity.

Example 6. The side dam of any preceding or subsequent examples or combination of examples, wherein the insulator is configured to be adjacent an injector of the continuous metal casting apparatus and extend upstream relative to the injector.

Example 7. The side dam of any preceding or subsequent examples or combination of examples, wherein the insulator comprises an insulator surface, wherein the insulator surface comprises a plurality of pockets, and wherein the endless belt is movable such that the portion of the endless belt configured to face the casting cavity is adjacent to the insulator surface comprising the plurality of pockets.

Example 8. A continuous casting apparatus comprising: a first endless casting belt comprising a first casting surface; a second endless casting belt comprising a second casting surface, wherein the first casting surface and the second casting surface define the casting cavity; and the side dam of any preceding or subsequent examples or combination of examples.

Example 9. The continuous casting apparatus o of any preceding or subsequent examples or combination of examples, wherein a speed of the endless belt is adjustable such that the speed of the endless belt matches a speed of the first casting surface and a speed of the second casting surface.

Example 10. The continuous casting apparatus of any preceding or subsequent examples or combination of examples, wherein the casting cavity and the endless belt form a moving cavity that is static relative to a cast slab.

Example 11. A side dam for a continuous metal casting apparatus comprising: an insulator comprising an insulator surface, wherein the insulator surface comprises a plurality of pockets; and a belt system comprising an endless belt movably supported such that the endless belt is movable relative to the insulator, wherein the endless belt comprises a belt surface and a portion of the belt surface is configured to face a casting cavity of the continuous metal casting apparatus as the endless belt is moved, and wherein the endless belt is movable such that the portion of the endless belt configured to face the casting cavity is adjacent to the insulator surface comprising the plurality of pockets.

Example 12. The side dam of any preceding or subsequent examples or combination of examples, wherein the endless belt is movable in a plane of motion that is perpendicular to the belt surface.

Example 13. The side dam of any preceding or subsequent examples or combination of examples, wherein the belt system further comprises: at least one pulley supporting the endless belt; a belt drive motor configured to move the endless belt relative to the insulator; and a belt tensioner configured to adjust a tension of the endless belt.

Example 13a. The side dam of any preceding or subsequent examples or combination of examples, wherein the belt system further comprises at least one pulley supporting the endless belt, and wherein the at least one pulley is a cooled pulley.

Example 13b. The side dam of any preceding or subsequent examples or combination of examples, wherein the at least one pulley is internally cooled.

Example 13c. The side dam of any preceding or subsequent examples or combination of examples, wherein the at least one pulley is air cooled or water cooled.

Example 13d. The side dam of any preceding or subsequent examples or combination of examples, wherein the belt system further comprises at least one pulley supporting the endless belt, and wherein the at least one pulley comprises at least one of an idler pulley, a drive pulley, or a tensioner pulley.

Example 13e. The side dam of any preceding or subsequent examples or combination of examples, further comprising a belt tensioner, and wherein the belt tensioner is a linear belt tensioner.

Example 13f. The side dam of any preceding or subsequent examples or combination of examples, wherein the side dam further comprises a cavity-facing side and an outwards facing side, and wherein a path of the endless belt along the cavity-facing side comprises a first portion and a second portion, and wherein the portion of the endless belt in the first portion of the path is non-coplanar in a direction along a length of the side dam with a portion of the endless belt in the second portion of the path.

Example 14. The side dam of any preceding or subsequent examples or combination of examples, further comprising: a support; and a water cooled backing connected to the support, wherein the insulator is supported on the water cooled backing, wherein the endless belt is movably supported on the support and the endless belt is movable between the insulator and the casting cavity and between the water cooled backing and the casting cavity.

Example 15. The side dam of any preceding or subsequent examples or combination of examples, wherein the side dam comprises a side dam length, wherein the insulator comprises an insulator length, and wherein the insulator length is less than the side dam length.

Example 16. The side dam of any preceding or subsequent examples or combination of examples, wherein the side dam length is less than a length of the casting cavity.

Example 17. The side dam of any preceding or subsequent examples or combination of examples, wherein the insulator is configured to be adjacent an injector of the continuous metal casting apparatus and extend upstream relative to the injector.

Example 18. The side dam of any preceding or subsequent examples or combination of examples, wherein the insulator comprises an insulator surface, wherein the insulator surface comprises a plurality of pockets, and wherein the endless belt is movable such that the portion of the endless belt configured to face the casting cavity is adjacent to the insulator surface comprising the plurality of pockets.

Example 19. A continuous casting apparatus comprising: a first endless casting belt comprising a first casting surface; a second endless casting belt comprising a second casting surface, wherein the first casting surface and the second casting surface define the casting cavity; and the side dam of any preceding or subsequent examples or combination of examples.

Example 20. The continuous casting apparatus of any preceding or subsequent examples or combination of examples, wherein a speed of the endless belt is adjustable such that the speed of the endless belt matches a speed of the first casting surface and a speed of the second casting surface.

Example 21. The continuous casting apparatus of any preceding or subsequent examples or combination of examples, wherein the casting cavity and the endless belt form a moving cavity that is static relative to a cast slab.

Example 22. A side dam for a continuous metal casting apparatus comprising: a support; and a belt system comprising an endless belt and a tensioner, wherein the endless belt is movably supported on the support such that the endless belt is movable relative to the support, wherein the endless belt comprises a belt surface and a portion of the belt surface of the endless belt is configured to face a casting cavity of the continuous metal casting apparatus as the endless belt is moved, and wherein a tension of the endless belt is adjustable through the tensioner.

Example 23. The side dam of any of any preceding or subsequent examples or combination of examples, further comprising an insulator connected to the support, wherein the endless belt is movable relative to the insulator.

Example 24. The side dam of any preceding or subsequent examples or combination of examples, wherein the insulator comprises an insulator surface, wherein the insulator surface comprises a plurality of pockets, and wherein the endless belt is movable such that the portion of the endless belt configured to face the casting cavity is adjacent to the insulator surface comprising the plurality of pockets.

Example 25. The side dam of any preceding or subsequent examples or combination of examples, wherein the endless belt is movable in a plane of motion that is perpendicular to the belt surface, and in some optional examples, the plane of motion is a horizontal plane.

Example 26. The side dam of any preceding or subsequent examples or combination of examples, wherein the belt system further comprises: at least one pulley supporting the endless belt; and a belt drive motor configured to move the endless belt relative to the insulator.

Example 27. The side dam of any preceding or subsequent examples or combination of examples, further comprising: an insulator; and a water cooled backing connected to the support, wherein the insulator is supported on the water cooled backing, wherein the endless belt is movably supported on the support and the endless belt is movable between the insulator and the casting cavity and between the water cooled backing and the casting cavity.

Example 28. The side dam of any preceding or subsequent examples or combination of examples, further comprising an insulator, wherein the side dam comprises a side dam length, wherein the insulator comprises an insulator length, and wherein the insulator length is less than the side dam length.

Example 29. The side dam of any preceding or subsequent examples or combination of examples, wherein the side dam length is less than a length of the casting cavity.

Example 30. The side dam of any preceding or subsequent examples or combination of examples, further comprising an insulator, wherein the insulator is configured to be adjacent an injector of the continuous metal casting apparatus and extend upstream relative to the injector.

Example 31. A continuous casting apparatus comprising: a first endless casting belt comprising a first casting surface; a second endless casting belt comprising a second casting surface, wherein the first casting surface and the second casting surface define the casting cavity; and the side dam of any preceding or subsequent examples or combination of examples.

Example 32. The continuous casting apparatus of any preceding or subsequent examples or combination of examples, wherein a speed of the endless belt is adjustable such that the speed of the endless belt matches a speed of the first casting surface and a speed of the second casting surface.

Example 33. The continuous casting apparatus of any preceding or subsequent examples or combination of examples, wherein the casting cavity and the endless belt form a moving cavity that is static relative to a cast slab.

Example 34. A method of continuously casting a solidified metal product comprising: feeding a molten metal into a casting cavity of a continuous caster, wherein a portion of a belt face of an endless belt of a side dam faces the casting cavity; and advancing the molten metal through the casting cavity and solidifying the molten metal to form the solidified metal product, wherein advancing the molten metal comprises moving the endless belt with the molten metal relative to an insulator of the side dam such that the endless belt moves adjacent to an insulator surface of the insulator comprising a plurality of pockets.

Example 35. The method of any preceding or subsequent examples or combination of examples, wherein moving the endless belt comprises moving the endless belt in a plane of motion that is perpendicular to the belt face, and in some optional examples, the plane of motion is a horizontal plane.

Example 36. The method of any preceding or subsequent examples or combination of examples, wherein moving the endless belt comprises moving the endless belt at a speed that matches a speed of a casting surface of the casting cavity to form a moving cavity that is static relative to the molten metal.

Example 37. The method of any preceding or subsequent examples or combination of examples, wherein the molten metal comprises aluminum.

Example 38. The method of any preceding or subsequent examples or combination of examples, wherein the aluminum is selected from a group consisting of a 1xxx series aluminum alloy, a 2xxx series aluminum alloy, a 3xxx series aluminum alloy, a 4xxx series aluminum alloy, a 5xxx series aluminum alloy, a 6xxx series aluminum alloy, a 7xxx series aluminum alloy, and an 8xxx series aluminum alloy.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A side dam for a continuous metal casting apparatus comprising:

an insulator;

a belt system comprising an endless belt movably supported such that the endless belt is movable relative to the insulator, a support; and a water cooled backing connected to the support, wherein the insulator is supported on the water cooled backing, wherein the endless belt is movably supported on the support and the endless belt is movable between the insulator and the casting cavity and between the water cooled backing and the casting cavity wherein the endless belt comprises a belt surface and a portion of the belt surface of the endless belt is configured to face a casting cavity of the continuous metal casting apparatus as the endless belt is moved, and wherein the endless belt is movable in a plane of motion that is perpendicular to the belt surface.

2. The side dam of claim 1, wherein the belt system further comprises:

at least one pulley supporting the endless belt;

a belt drive motor configured to move the endless belt relative to the insulator; and a belt tensioner configured to adjust a tension of the endless belt.

3. The side dam of claim 1, wherein the side dam comprises a side dam length, wherein the insulator comprises an insulator length, and wherein the insulator length is less than the side dam length.

4. The side dam of claim 1, wherein the insulator comprises an insulator surface, wherein the insulator surface comprises a plurality of pockets, and wherein the endless belt is movable such that the portion of the endless belt configured to face the casting cavity is adjacent to the insulator surface comprising the plurality of pockets.

5. A continuous casting apparatus comprising:

the side dam of claim 1;

a first endless casting belt comprising a first casting surface; and a second endless casting belt comprising a second casting surface, wherein the first casting surface and the second casting surface define the casting cavity.

6. The continuous casting apparatus of claim 5, further comprising an injector, wherein the insulator is adjacent to the injector of the continuous metal casting apparatus and extends upstream relative to the injector.

7. A side dam for a continuous metal casting apparatus comprising:

an insulator comprising an insulator surface, wherein the insulator surface comprises a plurality of pockets;

a belt system comprising an endless belt movably supported such that the endless belt is movable relative to the insulator, a support; and a water cooled backing connected to the support, wherein the insulator is supported on the water cooled backing, wherein the endless belt is movably supported on the support and the endless belt is movable between the insulator and the casting cavity and between the water cooled backing and the casting cavity wherein the endless belt comprises a belt surface and a portion of the belt surface is configured to face a casting cavity of the continuous metal casting apparatus as the endless belt is moved, and wherein the endless belt is movable such that the portion of the endless belt configured to face the casting cavity is adjacent to the insulator surface comprising the plurality of pockets.

8. The side dam of claim 7, wherein the endless belt is movable in a horizontal plane of motion that is perpendicular to the belt surface.

9. The side dam of claim 7, wherein the belt system further comprises:

at least one pulley supporting the endless belt;

a belt drive motor configured to move the endless belt relative to the insulator; and a belt tensioner configured to adjust a tension of the endless belt.

10. The side dam of claim 7, wherein the side dam comprises a side dam length, wherein the insulator comprises an insulator length, and wherein the insulator length is less than the side dam length.

11. The side dam of claim 7, wherein the insulator comprises an insulator surface, wherein the insulator surface comprises a plurality of pockets, and wherein the endless belt is movable such that the portion of the endless belt configured to face the casting cavity is adjacent to the insulator surface comprising the plurality of pockets.

12. A continuous casting apparatus comprising:

the side dam of claim 7;

a first endless casting belt comprising a first casting surface;

a second endless casting belt comprising a second casting surface, wherein the first casting surface and the second casting surface define the casting cavity; and an injector, wherein the insulator is adjacent to the injector of the continuous metal casting apparatus and extends upstream relative to the injector, and wherein the casting cavity and the endless belt form a moving cavity that is static relative to a cast slab.

13. A side dam for a continuous metal casting apparatus comprising:

a support;

a belt system comprising an endless belt and a tensioner, an insulator connected to the support; and a water cooled backing connected to the support, wherein the insulator is supported on the water cooled backing, wherein the endless belt is movably supported on the support and the endless belt is movable between the insulator and the casting cavity and between the water cooled backing and the casting cavity wherein the endless belt is movably supported on the support such that the endless belt is movable relative to the support, wherein the endless belt comprises a belt surface and a portion of the belt surface of the endless belt is configured to face a casting cavity of the continuous metal casting apparatus as the endless belt is moved, and wherein a tension of the endless belt is adjustable through the tensioner.

14. The side dam of claim 13, wherein the endless belt is movable in a horizontal plane of motion that is perpendicular to the belt surface.

15. The side dam of claim 13, further comprising an insulator connected to the support, wherein the endless belt is movable relative to the insulator, wherein the insulator comprises an insulator surface, wherein the insulator surface comprises a plurality of pockets, and wherein the endless belt is movable such that the portion of the endless belt configured to face the casting cavity is adjacent to the insulator surface comprising the plurality of pockets.

16. The side dam of claim 13, further comprising an insulator, wherein the side dam comprises a side dam length, wherein the insulator comprises an insulator length, and wherein the insulator length is less than the side dam length.

17. A continuous casting apparatus comprising:

the side dam of claim 13;

a first endless casting belt comprising a first casting surface;

a second endless casting belt comprising a second casting surface, wherein the first casting surface and the second casting surface define the casting cavity; and wherein the casting cavity and the endless belt form a moving cavity that is static relative to a cast slab.

* * * * *